US009077100B2

(12) United States Patent
Hodge

(10) Patent No.: US 9,077,100 B2
(45) Date of Patent: Jul. 7, 2015

(54) RECEPTACLE CONNECTOR

(75) Inventor: Ronald C. Hodge, Aurora, IL (US)

(73) Assignee: Molex Incorporated, Lisle, IL (US)

( * ) Notice: Subject to any disclaimer, the term of this patent is extended or adjusted under 35 U.S.C. 154(b) by 103 days.

(21) Appl. No.: 13/825,843

(22) PCT Filed: Sep. 30, 2010

(86) PCT No.: PCT/US2010/050925

§ 371 (c)(1),
(2), (4) Date: May 30, 2013

(87) PCT Pub. No.: WO2012/044304

PCT Pub. Date: Apr. 5, 2012

(65) Prior Publication Data

US 2013/0244465 A1 Sep. 19, 2013

(51) Int. Cl.

| | |
|---|---|
| ***H01R 13/52*** | (2006.01) |
| ***H01R 31/06*** | (2006.01) |
| *H01R 103/00* | (2006.01) |

(52) U.S. Cl.

CPC ..... *H01R 13/5219* (2013.01); *H01R 31/06* (2013.01); *H01R 2103/00* (2013.01)

(58) Field of Classification Search

CPC . H01R 13/5219; H01R 31/06; H01R 2103/00
USPC ..... 439/271–273, 278–283
See application file for complete search history.

(56) References Cited

U.S. PATENT DOCUMENTS

| | | | | |
|---|---|---|---|---|
| 2,935,720 | A | 5/1960 | Lorimer | |
| 3,491,326 | A | 1/1970 | Pfister et al. | |
| 4,902,247 | A | 2/1990 | Suzuki et al. | |
| 4,940,421 | A * | 7/1990 | Kano et al. | 439/273 |
| 5,125,848 | A | 6/1992 | Zimmerly | |
| 5,132,495 | A | 7/1992 | Ewing et al. | |
| 6,443,764 | B2 * | 9/2002 | Makita | 439/587 |
| 7,407,412 | B2 | 8/2008 | Khemakhem | |
| 7,435,123 | B2 | 10/2008 | Franks, Jr. | |
| 7,683,260 | B2 | 3/2010 | Bertini et al. | |
| 2001/0024908 | A1 | 9/2001 | Nakamura et al. | |

FOREIGN PATENT DOCUMENTS

| | | | |
|---|---|---|---|
| GB | 1000584 | A | 8/1965 |
| TW | 385078 | U | 11/2000 |

OTHER PUBLICATIONS

International Search Report for PCT/US2010/050925.

* cited by examiner

*Primary Examiner* — Khiem Nguyen
(74) *Attorney, Agent, or Firm* — Stephen L. Sheldon

(57) ABSTRACT

A receptacle connector includes an insulative body, conductive terminals mounted therein, and a seal covering a central portion of the body. The receptacle connector mates with at least one mating electrical connector. The seal prevents the intrusion of dust into the joint between the receptacle connector and the mating electrical connector(s). The seal and the body have locking features provided thereon to secure the seal to the housing.

12 Claims, 8 Drawing Sheets

RECEPTACLE CONNECTOR

FIELD OF THE INVENTION

The present invention relates to a receptacle connector for interconnecting two electrical connectors together.

BACKGROUND OF THE INVENTION

Traditionally, a receptacle connector is adapted to electrically mate with a mating electrical connector, such as a plug connector. The receptacle connector includes a body and a plurality of terminals received in terminal receiving passageways through the body.

When the plug connector is inserted in the receptacle connector, the connection between the receptacle connector and the plug connector must be sealed to prevent the intrusion of dust into the connectors since the terminals of the connectors are easily dirtied and degraded by dust. Therefore, a dustproof receptacle connector is needed urgently.

SUMMARY OF THE INVENTION

A receptacle connector includes an insulative body, conductive terminals mounted therein, and a seal covering a central portion of the body. The receptacle connector mates with at least one mating electrical connector. The seal prevents the intrusion of dust into the joint between the receptacle connector and the mating electrical connector(s). The seal and the body have locking features provided thereon to secure the seal to the housing.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which.

DETAILED DESCRIPTION OF THE ILLUSTRATED EMBODIMENTS

Figure 1:
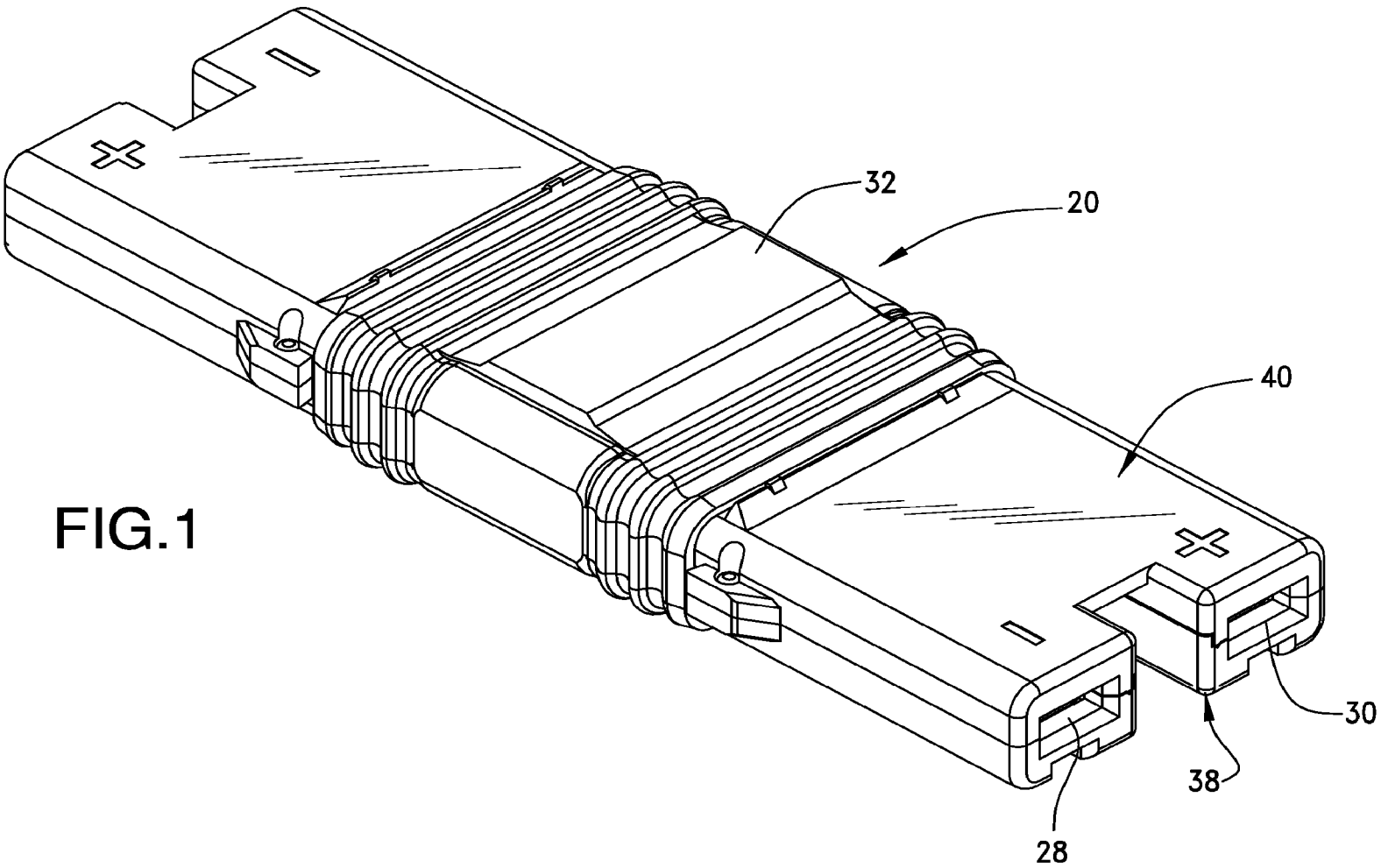
FIG. 1 is a perspective view of an embodiment of a receptacle connector.

There is shown in the drawings, and as described in detail, specific embodiments with the understanding that the present disclosure is to be considered an example of the principles features that may be used together, and is not intended to be limited to the specific embodiment that are illustrated and described herein. Therefore, unless otherwise noted, features disclosed herein may be combined together to form additional combinations that were not otherwise shown for purposes of brevity.

A receptacle connector 20 includes a body 22 (which can be formed of a dielectric or insulative material), conductive terminals 24, 26 housed within terminal receiving passageways 28, 30 in the body 22, and a seal 32 surrounding and mated to the body 22. The receptacle connector 20 is capable of being mated to a first electrical connector 34 at one end thereof and is capable of being mated to a second electrical connector 36 at the other end thereof. The seal 32 prevents dust intrusion into the joint between the first mating electrical connector 34 and the body 22 and between the second mating electrical connector 36 and the body 22. Terminals (not shown) in the first mating electrical connector 34 connect to one end of the terminals 24, 26 in the body 22; the terminals (not shown) in the second mating electrical connector 36 connect to the other end of the terminals 24, 26 in the body 22. Therefore, an electrical connection can be provided between the first and second electrical connectors 34, 36 via the receptacle connector 20.

As depicted, the body 22 is formed from first and second shells 38, 40 which are joined together. As depicted, the first and second shells 38, 40 are identically formed, and therefore, only the specifics of the first shell 38 are described. As can be appreciated, however, the first and second shell need not be identical.

The first shell 38 has a generally rectangular, planar base wall 42 having first and second opposite ends and first and second opposite sides extending between the ends. A planar side wall 44, 46 extends perpendicularly to the base wall 42 from each side thereof.

A cutout 48 is provided in each end of the body 22 and includes a first side extending from the first end of the base wall 42 a predetermined distance toward the second end, a second side extending from the first end of the base wall 42 the same predetermined distance toward the second end, and an inner side connecting the inner ends of the first and second sides together. At each end of the base wall 42, a first end wall 50 extends perpendicularly to the base wall 42 and extends from the side wall 44 to the first side of the cutout 48; a second wall 52 extends perpendicularly to the base wall 42 and along the first side of the cutout 48; a third wall 54 extends perpendicularly to the base wall 42 and along the third side of the cutout 48; a fourth wall 56 extends perpendicularly to the base wall 42 and along the second side of the cutout 48; and a fifth end wall 58 extends perpendicularly to the base wall 42 and extends from the side wall 46 to the second side of the cutout 48. The walls 42, 44, 46, 50, 52, 54, 56, 58 are integrally formed.

A three-sided recess 60 is provided in each first wall 50 and a three-sided recess 62 is provided in each fifth wall 58. Each recess 60 has a first surface 64 extending perpendicularly along the first wall 50 a predetermined distance, a second surface 66 extending perpendicularly along the first wall 50 a predetermined distance, and a third surface 68 extending between the ends of the first and second surfaces 64, 66. An edge of each surface 64, 66, 68 is chamfered to promote entry of the terminals of the mating electrical connectors 34, 36 therein. Each recess 64 has a first surface 70 extending perpendicularly along the fifth wall 58 a predetermined distance, a second surface 72 extending perpendicularly along the fifth wall 58 a predetermined distance, and a third surface 74 extending between the ends of the first and second surfaces 70, 72. An edge of each surface 70, 72, 74 is chamfered to promote entry of the terminals of the mating electrical connectors 34, 36 therein.

An elongated wall 76 extends perpendicularly to the base wall 42 and is aligned with and positioned between the second walls 52. An elongated wall 77 extends perpendicularly to the base wall 42 and is aligned with and positioned between the fourth walls 56. A half of the first terminal passageway 28 is thereby defined by the base wall 42, the first walls 52, the first end walls 50, the side wall 44 and the elongated wall 76. A half of the second terminal passageway 30 is thereby defined by the base wall 42, the fourth walls 56, the fifth end walls 58, the side wall 46 and the elongated wall 76. A terminal mounting pin 78*a* extends from the base wall 42 and extends into the half of the first terminal passageway 28; a terminal mounting pin 78*b* extends from the base wall 42 and extends into the half of the second terminal passageway 30.

The first terminal 24 is seated within the half of the first terminal passageway 28, and the second terminal 26 is seated within the half of the second terminal passageway 30. Each terminal 24, 26 has a main body 80 and a mating feature 82 at each end thereof which is positioned proximate to the ends of the half of the first terminal passageway 28. The mating features 28 securely hold the ends of the terminal from the mating electrical connectors 34, 36 when inserted therein. Each main body 80 has an aperture 84 therethrough through which the respective terminal mounting pin 78 seats when the terminal 24, 26 is seated within the respective halves of the terminal mounting passageways 28, 30.

As best shown in FIG., the base wall 42 includes a seal retention aperture 86 provided through the center thereof. The seal retention aperture 86 is positioned between and generally fills the space between the elongated walls 76, 77 and thus is offset from the terminal receiving passageways 28, 30. The seal retention aperture 86 is generally rectangular with rounded corners 88, with its length extending along the centerline 90 of the body 22. The seal retention aperture 86 has first and second opposite ends and first and second opposite sides extending between the ends. The base wall 42 forms a single locking tongue 92 which extends inwardly toward the center of the seal retention aperture 86 from the first end; the base wall 42 forms a single locking tongue 94 which extends inwardly toward the center of the seal retention aperture 86 from the second end; the base wall 42 forms a pair of spaced apart locking tongues 96*a*, 96*b* which extend inwardly toward the center of the seal retention aperture 86 from the first side; and the base wall 42 forms a pair of spaced apart locking tongues 98*a*, 98*b* which extend inwardly toward the center of the seal retention aperture 86 from the second side. The tongues 92, 94 extending from the ends have a first side extending at an angle relative to the centerline 90 and inwardly toward the center of the seal retention aperture 86, a second side extending at an angle relative to the centerline 90 and inwardly toward the center of the seal retention aperture 86, and a third side which is perpendicular to the centerline 90 and extends between the inner ends of the first and second sides. The tongues 96*a*, 96*b*, 98*a*, 98*b* extending from the sides have a first side extending at an angle relative to the centerline 90 and inwardly toward the center of the seal retention aperture 86, a second side extending perpendicularly to the centerline 90 and inwardly toward the center of the seal retention aperture 86, and a third side which is parallel to the centerline 90 and extends between the inner ends of the first and second sides. On the outer surface of the shell 38, see FIG., a chamfer 100 is provided on each wall forming the seal retention aperture 86 to promote the entry of the seal 32 into the seal retention aperture 86. On the inner surface of the shell 38, see FIG., each tongue 96*a*, 96*b*, 98*a*, 98*b* has a ramp extending perpendicularly from the base wall. Each ramp is formed by a ramped surface 99 which extends upwardly from and at an angle relative to the base wall 42, and a planar surface 101 extending from the end of the ramped surface and which is parallel to the base wall 42. The ramped surface 99 on tongue 96*a* faces the ramped surface 99 on tongue 96*a*. The ramped surface 99 on tongue 98*a* faces the ramped surface 99 on tongue 98*a*. The ramps extend parallel to the centerline 90.

A pin 103 extends perpendicularly to the base wall 42 and is positioned between the tongue 92 and the third wall 54. A pin 105 extends perpendicularly to the base wall 42 and is positioned between the tongue 94 and the third wall 54.

A first pair of apertures 102*a*, 102*b* are provided between the tongues 96*a*, 96*b* and the side wall 44. A second pair of apertures 104*a*, 104*b* are provided between the tongues 98*a*, 98*b* and the side wall 46.

First and second elongated locking bars 106, 108 are provided on the outer surface of the base wall 42. Each locking bar 106, 108 has a first surface 110 which extends perpendicularly from the outer surface of the base wall 42 and a second tapered surface 112 which extends from the outer surface of the base wall 42 to the outer end of the first surface 110. The first surface 110 of the first locking bar 106 is proximate to, but spaced from the first end of the seal retention aperture 86; the first surface 110 of the second locking 108 bar is proximate to, but spaced from the second end of the seal retention aperture 86. Therefore, each tapered surface 112 faces outwardly to promote the insertion of the receptacle connector 20 into the mating electrical connector 34, 36. Each locking bar 106, 108 has a pair of protrusions 114 extending outwardly therefrom for mating into an associated aperture (not shown) in the mating electrical connector 34, 36 to lock the mating electrical connector 34, 36 onto the receptacle connector 20.

A pair of protrusions 116 extend outwardly from each side wall 44, 46. In the protrusions 116 extending from side wall 44, a pin 118 extends therefrom in a direction opposite to that of the base wall 42. In the protrusions 116 extending from side wall 48, an aperture 120 is provided through each protrusion 116.

When the shells 38, 40 are mated together to form the body 22, the pins 118 on the first shell 38 are inserted into the apertures 120 on the second shell 40, and the pins 118 on the second shell 40 are inserted into the apertures 120 on the first shell 38. The ends of the walls 42, 44, 46, 50, 52, 54, 56, 58 on the first shell 38 mate with the ends of the walls 42, 44, 46, 50, 52, 54, 56, 58 on the second shell 40. As a result, the halves of the first terminal passageways 28 mate to form the first terminal passageway 28 through the body 22; the halves of the second terminal passageways 30 mate to form the second terminal passageway 30 through the body 22. The ends of the terminal mounting pins 78 abut against each other. After mating, the shells 38, 40 are suitably permanently mated together, such as by ultrasonic welding. The seal retention apertures 86 in each shell 38, 40 align with each other, and the respective ramps align, and a cavity is defined therebetween; the first pair of apertures 102*a*, 102*b* in each shell 38, 40 align with each other; and the second pair of apertures 104*a*, 104 in each shell 38, 40 align with each other.

The seal 32 can be formed of an elastomeric material, such as a silicone rubber. The seal includes an outer ring 200 which is generally sized to closely conform to the shape of the portion of the body 22 between the locking bars 106, 108. The outer ring 200 has a first wall 202, a second wall 204 which is parallel to the first wall 202, a third wall 206 which is generally perpendicular to the first and second walls 202, 204 and connects the first and second walls 202, 204 together at an end of each wall 202, 204, and a fourth wall 208 which is generally perpendicular to the first and second walls 202, 204, connects the first and second walls 202, 204 together at the opposite end of each wall 202, 204, and is parallel to the third wall 206. Each wall 202, 204, 206, 208 is generally rectangular. A central passageway 210 is defined through the center of the outer ring 200.

A plurality of spaced apart ribs 212*a*, 212*b* extend around the outer surface of the outer ring 200 to form first and second sets of ribs 212*a*, 212*b*. The thickness of the ribs 212*a*, 212*b* can be varied as desired but preferably can provide an aesthetically pleasing and ornamental look to the receptacle connector 20. A central raised block 214 extends around the outer surface of the outer ring 200 to separate the first and second sets of ribs 212*a*, 212*b* from each other.

A locking extension 216 extends into the central passageway 210 from the third wall 204; a locking extension 218 extends into the central passageway 210 from the first wall 202. Each locking extension 216, 218 is generally T-shaped and includes a base 220 extending inwardly toward the center of the central passageway 210 from the respective wall 202, 204, and a flange 222 provided at the inner end of the base 220. The base 220 is rectangular in cross-section and is sized to be slightly larger than the seal retention aperture 86 through the body 22. The flange 222 is perpendicular to the base 220 and parallel to the respective wall 202, 204. Each flange 222 is sized to be substantially larger than the base 220 (and thus the seal retention aperture 86) such that a portion of the flange 222 extends outwardly from each side of the base 220. Each flange 222 has a planar inner surface 224 which faces the other flange 222 and is spaced therefrom, first and second opposite ends, first and second opposite sides extending between the ends, and a planar outer surface 226. The inner surface 224 and the outer surface 226 are parallel to each other. The ends of the flange 222 have a first ramped surface 228 which extends from the inner surface 224 outwardly and an angle relative to the inner surface 224, and a second surface 230 which extends from the inner surface 224 to the outer surface 226. The second surface 230 is generally perpendicular to the inner and outer surfaces 224, 226.

As best shown in FIG., a protrusion 232 extends from wall 202 into the central passageway 210, and a protrusion 236 extends from wall 204 into the central passageway 210. The protrusions 232, 236 are positioned between the seal retention aperture 86 and the side wall 206. A protrusion 234 extends from wall 202 into the central passageway 210; a protrusion 238 extends from wall 204 into the central passageway 210. The protrusions 234, 238 are positioned between the seal retention aperture 86 and the side wall 208.

The seal 32 attaches to the body 22 by inserting an end of the body 22 into the central passageway 210 and sliding the outer ring 200 over the body 22 until the locking extensions 216, 218 are positioned over the seal retention apertures 86 in the base walls 42. Because the seal 32 is formed of silicone rubber, the outer ring 200 can flex to provide clearance for the locking extensions 216, 218 to move along the base walls 42 and over the locking bars 106, 108. When the seal 32 is properly positioned, the user presses on the outer surface of the outer ring 200 to cause the locking extensions 216, 218 to enter into the apertures. The ramped surfaces 228 on the flanges 222 engage with the chamfers 100 on the walls forming the seal retention aperture 86 and slide along the chamfers 100. Once the flanges 222 clear the inner surface of the base wall 42, the flanges 222 seat on the surfaces 99, 101 of the ramps. When the locking extensions 216, 218 are fully inserted, the flanges 222 seat on the interior surface of the respective base walls 42 and the ramps and the bases 220 seat within the respective seal retention apertures 86. The ramps press into the outer surface 218 of the respective flanges 222 to lock the flanges 222 to the body 22. Since each base 220 is slightly larger than the associated seal retention aperture 86, the tongues 92, 94, 96*a*, 96*b*, 98*a*, 98*b* press into the base 220 to securely hold the seal 32 in the body 22. The protrusions 232, 234, 236, 238 seat within the apertures 102*a*, 102*b*, 104*a*, 104*b* in the base wall 42. The outer ring 200 spans the distance between the locking bars 106, 108 to provide a large seal area on the exterior of the body 22. Since a large amount of overlap is provided, this seals the joint and prevents the incursion of dust into the joint.

The receptacle connector 20 is rectangular to provide an aesthetically pleasing and ornamental shape. It is understood that other shapes could be provided for the outer surface of the body 22 and the outer ring 200 of the seal 32, for example, the outer surface of the body 22 and the outer ring 200 could be circular.

Figure 2:
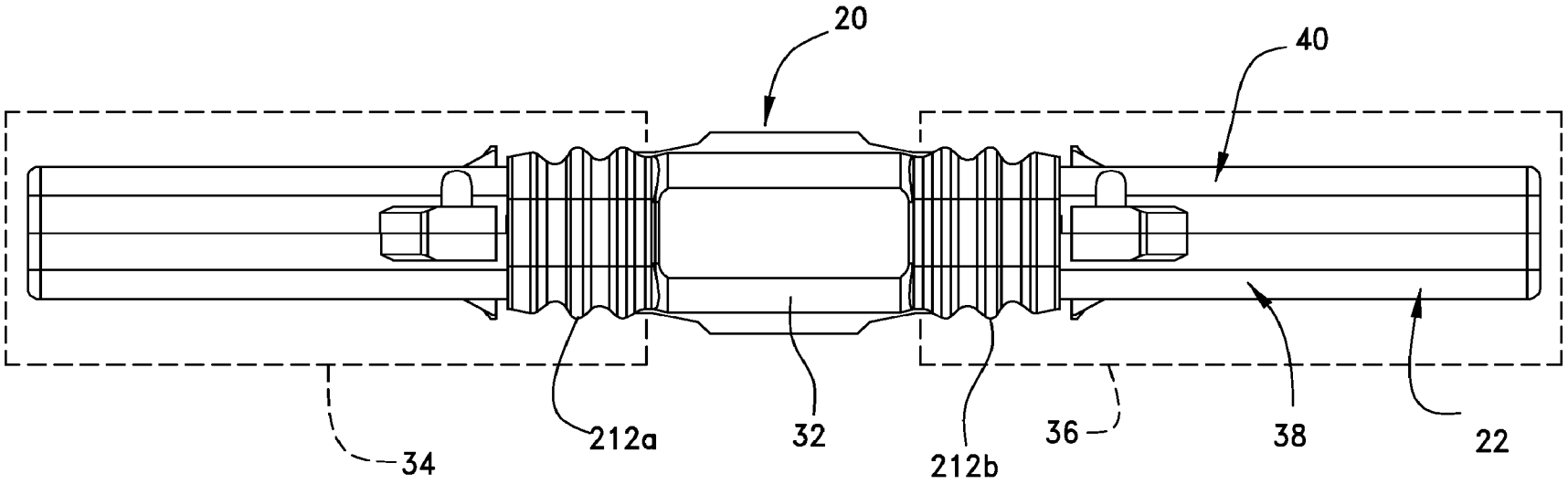
FIG. 2 is side elevational view of the receptacle connector of FIG. 1 and showing mating electrical connectors in phantom line.
Figure 3:
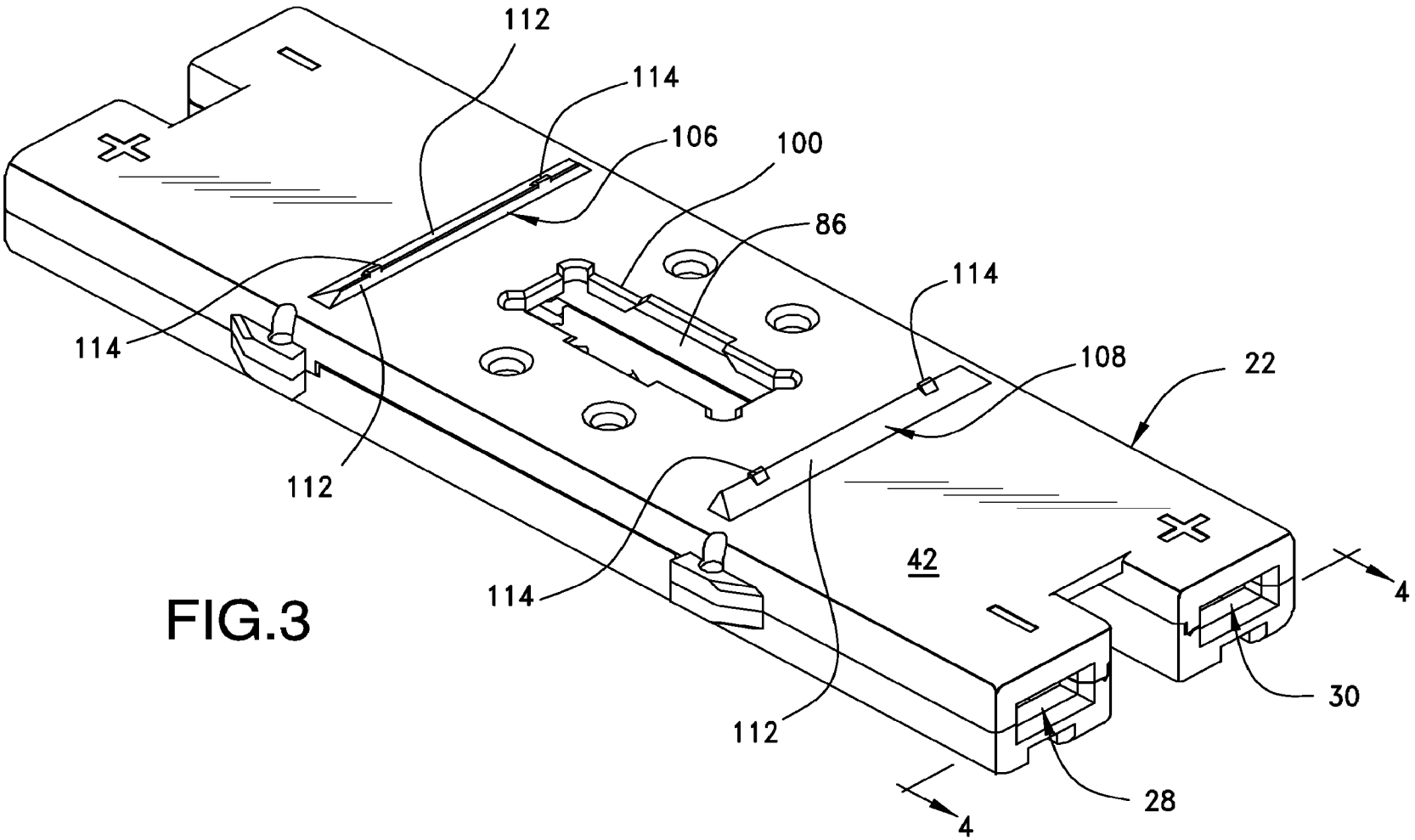
FIG. 3 is a perspective view of a body used in the receptacle connector of FIG. 1.
Figure 4:
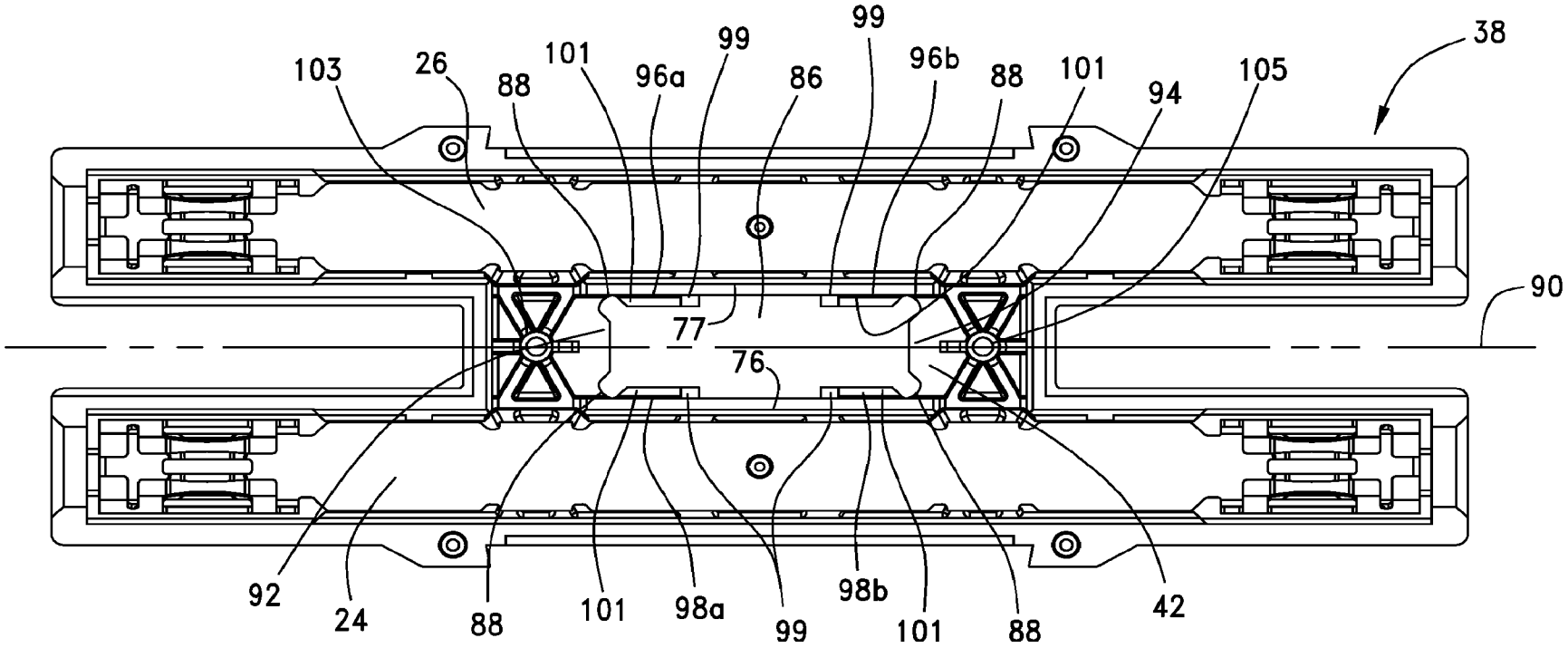
FIG. 4 is a cross-sectional view along line 4-4 of FIG. 3.
Figure 5:
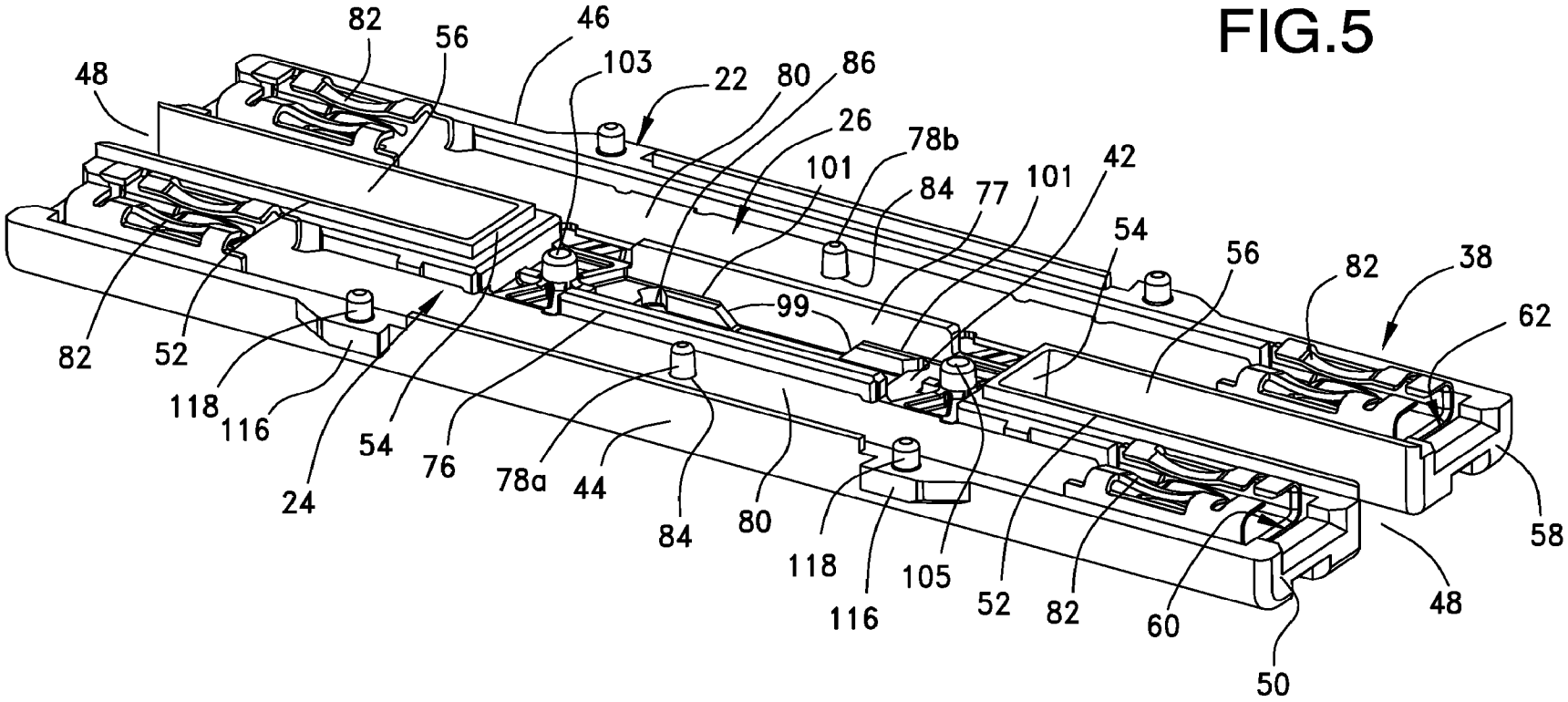
FIG. 5 is a perspective view of a shell of the body of FIG. 3.
Figure 6:
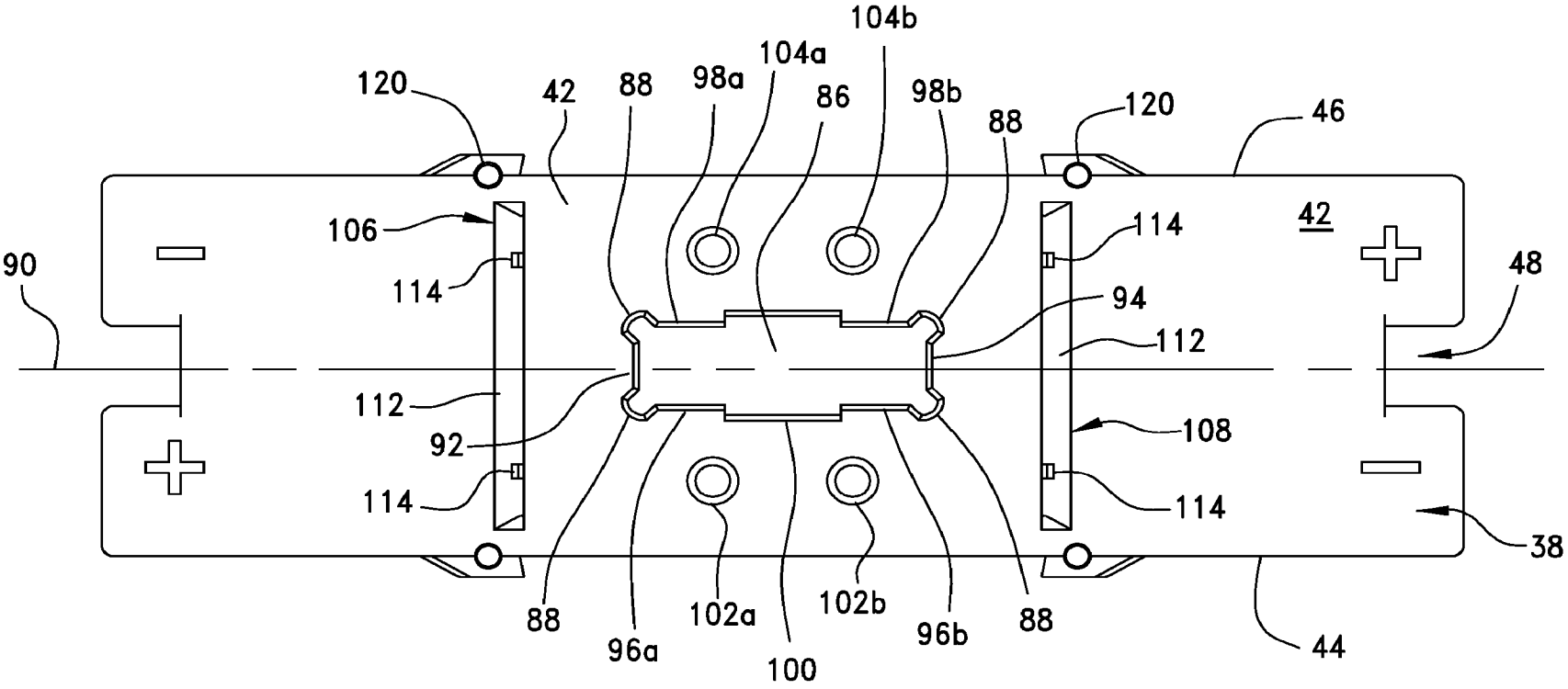
FIG. 6 is a plan view of the body of FIG. 3.
Figure 7:
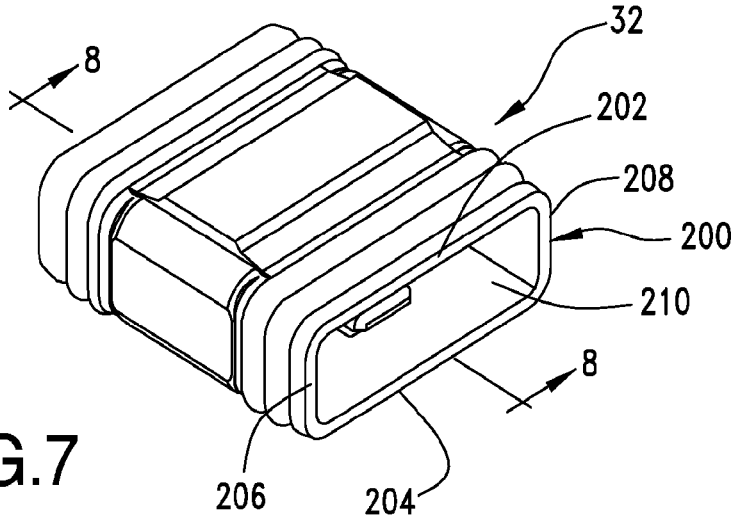
FIG. 7 is a perspective view of a seal used in the receptacle connector of FIG. 1.
Figure 8:
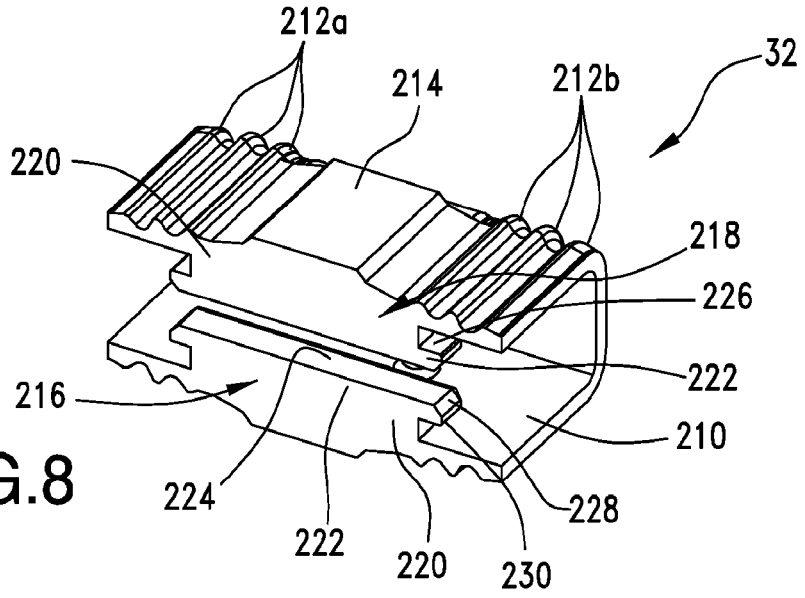
FIG. 8 is a cross-sectional view along line 8-8 of FIG. 7.
Figure 9:
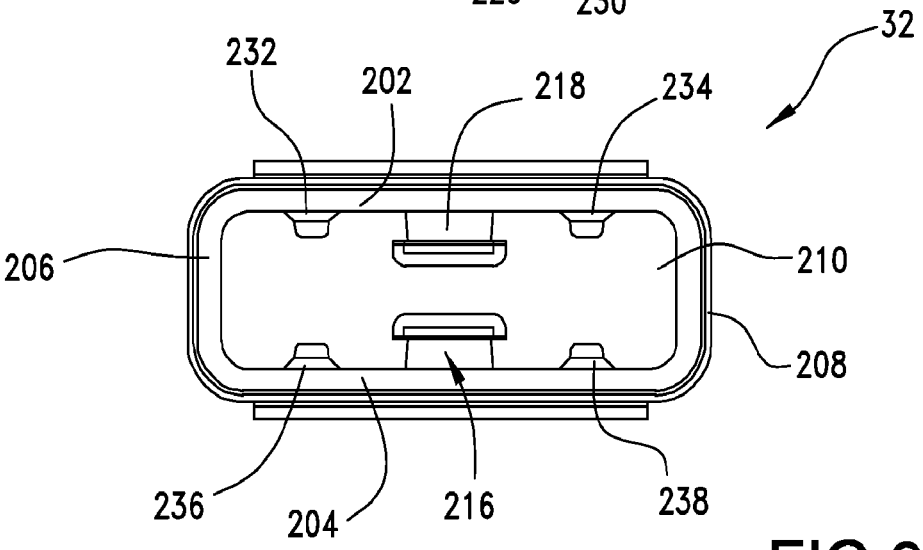
FIG. 9 is a end elevational view of the seal of FIG. 7.
Figure 10:
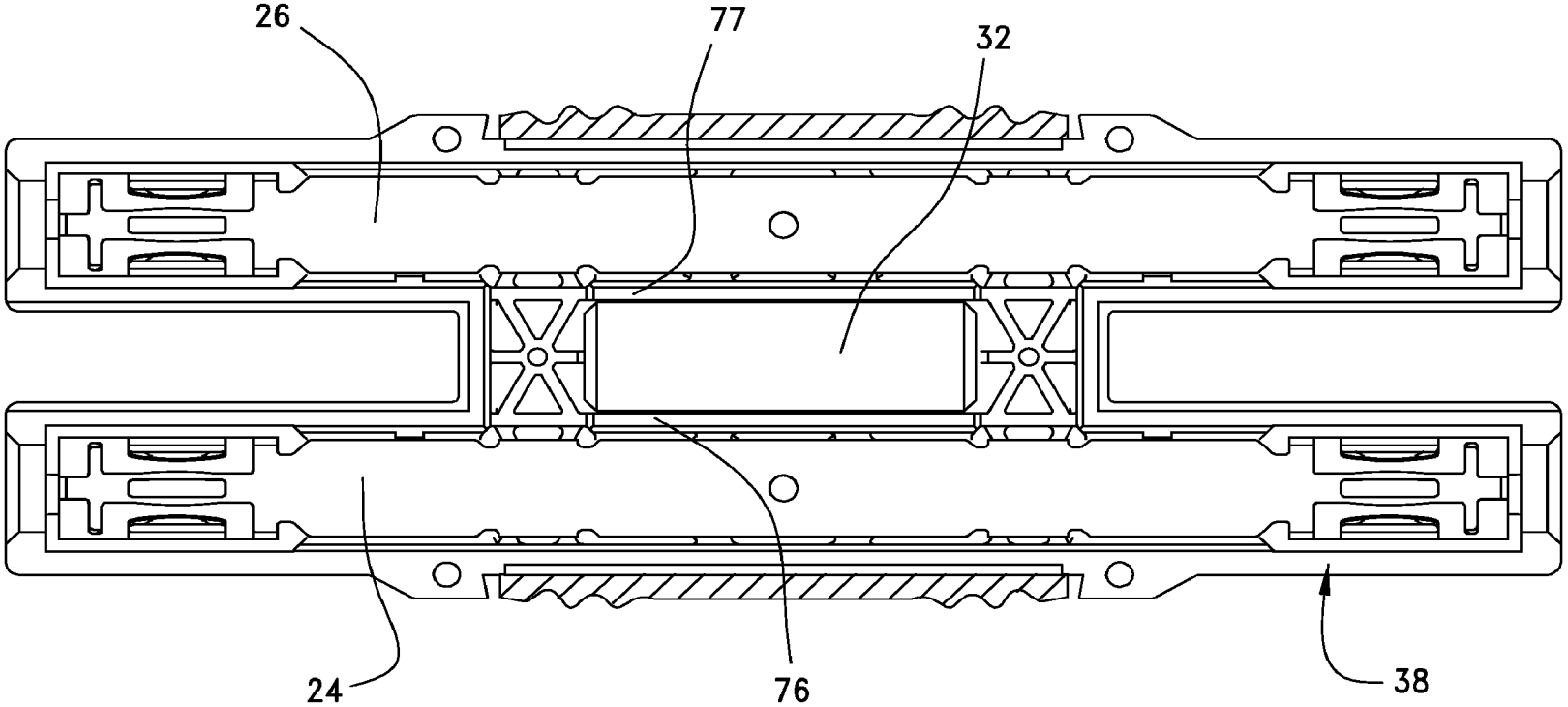
FIG. 10 is a plan of the shell of FIG. 5 with the seal of FIG. 7 attached thereto and shown in cross-section.

The housings of the mating electrical connectors 34, 36 overlap the ribs 212*a*, 212*b* of the seal 32 and compress the ribs 212*a*, 212*b* between the mating electrical connectors 34, 36 and the body 22 (the ribs are not shown compressed in FIG. 2). Since a large amount of overlap can be provided, this helps seal the joint and prevents the incursion of dust and moisture into the joint.

While preferred embodiment are shown and described herein, it is envisioned that those skilled in the art may devise various modifications of the disclosure without departing from the spirit and scope of the appended claims.

The invention claimed is:

1. A receptacle connector, comprising:

a body having a first and second end, an inner surface and an outer surface, a terminal receiving passageway extending substantially between the first and second end, and a seal retention aperture having a predetermined dimension provided therethrough, the seal retention aperture being spaced from the first and second ends and offset from the terminal receiving passageway;

a conductive terminal mounted in the terminal receiving passageway; and an elastomeric seal positioned between the first and second end and extending around the outer surface, the seal having an outer ring defining a passageway into which the body is seated, and a locking extension extending from the outer ring into the passageway, the locking extension comprising a base extending from the outer ring and a flange provided at an end of the base, the flange being larger in dimension than the base and the flange being larger in dimension than the seal retention aperture such that the flange is positioned within the housing and engages the inner surface of the housing, the base is seated within the seal retention aperture and the outer ring is positioned outside of the housing and engages the outer surface of the housing, the seal being removable from the body.

2. The receptacle connector of claim 1, wherein the seal retention aperture is defined by a wall, the wall defining a plurality of tongues extending into the seal retention aperture, the tongues engaging the base of the seal.

3. The receptacle connector of claim 2, further including a plurality of ramps provided on the body proximate to the seal retention aperture, the ramps engaging the flange.

4. The receptacle connector of claim 1, further including a plurality of ramps provided on the body proximate to the seal retention aperture, the ramps engaging the flange.

5. The receptacle connector of claim 1, wherein a chamfer is provided on the outer surface of the body surrounding the seal retention aperture, the flange engaging the chamfer when the locking extension is into inserted into the seal retention aperture.

6. The receptacle connector of claim 5, wherein the flange has a ramped surface which engages with the chamfer when the locking extension is inserted into the seal retention aperture.

7. The receptacle connector of claim 1, wherein two terminal receiving passageways are provided in the body and a conductive terminal is mounted in each the terminal receiving passageway, the seal retention aperture being positioned between the terminal receiving passageways.

8. The receptacle connector of claim 7, wherein each the terminal receiving passageway extends from a first end of the body to a second end of the body such that a mating electrical connector can be inserted into both ends of the body.

9. The receptacle connector of claim 1, wherein the seal includes two seal retention apertures and two locking extensions.

10. The receptacle connector of claim 1, wherein the seal includes ribs on an outer surface of the outer ring.

11. The receptacle connector of claim 1, wherein the body includes means for locking the mating electrical connectors to the body.

12. The receptacle connector of claim 1, wherein the terminal receiving passageway extends from a first end of the body to a second end of the body such that a mating electrical connector can be inserted into both ends of the body.

* * * * *